US007481625B2

(12) United States Patent
Kim

(10) Patent No.: US 7,481,625 B2
(45) Date of Patent: Jan. 27, 2009

(54) RADIAL-FLOW TURBINE WHEEL

(75) Inventor: Kyung-heui Kim, Changwon-si (KR)

(73) Assignee: Samsung Techwin Co., Ltd. (KR)

( * ) Notice: Subject to any disclaimer, the term of this patent is extended or adjusted under 35 U.S.C. 154(b) by 37 days.

(21) Appl. No.: 11/011,571

(22) Filed: Dec. 14, 2004

(65) Prior Publication Data

US 2006/0039791 A1 Feb. 23, 2006

(30) Foreign Application Priority Data

Aug. 20, 2004 (KR) ..... 10-2004-0065881

(51) Int. Cl.
*F01D 5/04* (2006.01)

(52) U.S. Cl. ..... 416/185; 416/248

(58) Field of Classification Search ..... 416/181–183, 416/185, 186 R, 188, 223 A, 223 B, 228, 416/248

See application file for complete search history.

(56) References Cited

U.S. PATENT DOCUMENTS

| | | | | | |
|---|---|---|---|---|---|
| 737,042 | A * | 8/1903 | Stumpf | 416/244 R |
| 2,390,506 | A * | 12/1945 | Buchi | 415/184 |
| 2,941,780 | A * | 6/1960 | Von Der Nuell et al. | 416/182 |
| 4,008,000 | A * | 2/1977 | Gradl et al. | 416/214 A |
| 4,062,638 | A * | 12/1977 | Hall, Jr. | 416/244 A |
| 4,189,282 | A * | 2/1980 | Benoist et al. | 416/221 |
| 4,890,980 | A * | 1/1990 | Heald et al. | 416/181 |
| 6,499,955 | B2 * | 12/2002 | Choi et al. | 416/185 |
| 7,033,137 | B2 * | 4/2006 | Shufeldt | 415/119 |
| 2005/0106028 | A1 * | 5/2005 | Ahmad | 416/228 |

FOREIGN PATENT DOCUMENTS

| | | | | |
|---|---|---|---|---|
| DE | 1185625 | A * | 1/1965 | 416/183 |
| DE | 2715011 | A * | 10/1978 | 416/181 |
| FR | 1325267 | A * | 3/1963 | 416/183 |

OTHER PUBLICATIONS

Notification of 1st Office Action (w/ English translation), Chinese Patent Office, Issued Jan. 18, 2008.

* cited by examiner

*Primary Examiner*—Ninh H Nguyen
(74) *Attorney, Agent, or Firm*—Parks & Associates IP Law LLC

(57) ABSTRACT

A radial-flow turbine wheel is provided. The radial-flow turbine wheel includes a hub having an outer radius gradually increasing from a front end to a rear end, a rear periphery of the hub being radially extended in a plane generally perpendicular to a center axis, and a plurality of turbine blades formed around the hub at constant intervals. A plurality of slots is formed by inward cuts at the rear periphery of the hub between the turbine blades of the hub. The turbine wheel restrains creation and propagation of cracks due to thermal stress, as well as improving a turbine efficiency.

8 Claims, 7 Drawing Sheets

RADIAL-FLOW TURBINE WHEEL

BACKGROUND OF THE INVENTION

This application claims the priority of Korean Patent Application No. 2004-65881, filed on Aug. 20, 2004, in the Korean Intellectual Property Office, the disclosure of which is incorporated herein in its entirety by reference.

1. Field of the Invention

The present invention relates to a radial-flow turbine wheel, and more particularly, to a radial-flow turbine wheel capable of restraining creation and propagation of a crack due to thermal stress, as well as improving a turbine efficiency.

2. Description of the Related Art

In general, a gas turbine is powered by expansion of an operating fluid of high temperature and high pressure, which is generated from the combustion process of a combustor, to drive a compressor coupled coaxially to the gas turbine. In an internal combustion engine with a turbocharger, a high-pressure gas compressed by the compressor is supplied to a fuel cell or a combustion cylinder of the internal combustion engine.

FIG. 1 is a cross-sectional view of a common turbocharger driven by such a gas turbine. Referring to FIG. 1, during operation of an internal combustion engine (not shown) coupled to the turbocharger, an exhaust gas F firstly flows in a spiral inflow casing 6 of the turbine. The exhaust gas F is accelerated in the inflow casing 6, and flows to turbine wheel 30. The exhaust gas F is expanded in the turbine wheel section 30, thereby generating an output to drive rotary shaft 5 and compressor wheel 4. The compressor wheel 4 compresses air A and supplies the compressed air to a combustion cylinder (not shown). Reference numeral C indicates the center of the rotary shaft 5.

FIG. 2 shows a conventional radial-flow turbine wheel 30 including a hub 10 and a plurality of turbine blades 20 formed around the hub 10 at constant intervals. The exhaust gas F flowing into the turbine wheel 30 flows along the turbine blades 20. In this process, the turbine blades 20 are urged to move in a rotating direction by the flow of exhaust gas F, so as to rotate the turbine wheel 30. According to the prior art, in order to reduce thermal stress and the weight of the gas turbine, a desired portion between the turbine blades 20 is cut away to form a scallop 60. As, a result, an outermost rear periphery 10*a* of the hub between the adjacent turbine blades has an inwardly concave shape.

However, an excessive formation of such scallops 60 results in deterioration of turbine efficiency. In particular, referring to FIG. 3, when the scallops are excessively formed (i.e., an outer radius R2 of the periphery 10*a* is remarkably reduced relative to the outer radius R1 of the turbine blade 20), the exhaust gas flowing into the turbine wheel 30 via a flow path may collide against the periphery 10*a* (indicated by F1) or may be leaked toward a back area B through a gap between the turbine wheel 30 and a wall 15 (indicated by F2). Since the exhaust gas colliding against the periphery 10a or leaked toward a back area B does not function as energy to drive the turbine wheel 30, there is a driving loss, which deteriorates turbine efficiency.

SUMMARY OF THE INVENTION

The present invention provides a radial-flow turbine wheel capable of improving a turbine efficiency.

Also, the present invention provides a radial-flow turbine wheel capable of restraining creation and propagation of crack due to thermal stress.

According to one aspect of the present invention, a radial-flow turbine wheel comprises: a hub having a generally cylindrical front end, an intermediate portion with an outer radius generally increasing from the front end to a rear end, the rear end of the hub having an enlarged outer periphery; a plurality of turbine blades formed around the hub at constant intervals; and, a plurality of slots formed in a generally radial direction at the enlarged outer periphery of the hub between the turbine blades.

The slot may have a rounded inner surface. The slot preferably has a depth of at least 3 mm.

The rear periphery of the hub preferably has an inwardly-formed concavity between the turbine blades. An innermost outer radius of the periphery is greater than about 75% of an outer radius of the turbine blade.

BRIEF DESCRIPTION OF DRAWINGS

The above and other features and advantages of the present invention will become more apparent by describing in detail exemplary embodiments thereof with reference to the attached drawings in which.

DETAILED DESCRIPTION OF PREFERRED EMBODIMENTS

Reference will now be made in detail to describe a radial-flow turbine wheel according to preferred embodiments of the present invention.

Figure 4:
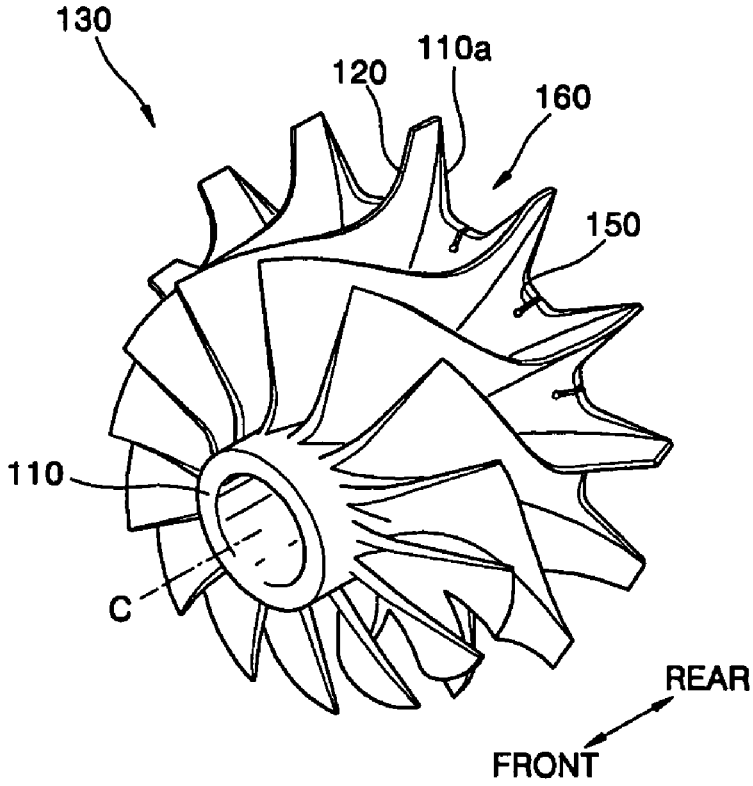
FIG. 4 is a perspective view of a turbine wheel according to one embodiment of the present invention.

FIG. 4 shows a turbine wheel 130 according to one embodiment of the present invention. Referring to FIG. 4, turbine wheel 130 includes a hub 110 and a plurality of turbine blades 120 formed around the hub 110 at constant intervals.

Hub 110 has an outer radius gradually increased from front to rear. The hub 110 includes a rear side periphery 110*a* (hereinafter, called a "rear periphery") radially extending in a plane perpendicular to center axis C. A rotary shaft (not shown) supporting the turbine wheel 130 is inserted into the center of the hub 110, and rotational energy is transferred from the turbine wheel 130 through the rotary shaft to a compressor wheel coaxially coupled to the rotary shaft. The hub 110 supports the plurality of turbine blades 120 formed-around the hub.

The turbine blades 120 convert pressure energy of an exhaust gas into rotational energy of the turbine wheel. In order to effectively transfer the pressure energy of the exhaust gas to the turbine wheel 130, the turbine blade 120 has a desired curvature in a circumferential direction, as shown in the drawing.

A scallop 160 is formed between the turbine blades 120, so that a rear periphery of the hub is formed in an inwardly concave shape. Such a scallop 160 may be formed by cutting a desired portion of a rear portion of the hub. Thermal stress can be reduced by cutting a portion of the rear portion of the hub directly contacting with the hot exhaust gas exited from a combustion chamber, thereby preventing a crack from being created due to thermal stress.

The rotary shaft supporting the turbine wheel 130 may be subject to bending deformation due to the weight of the turbine wheel 130, or to bending vibration due to a centrifugal force (i.e., inertial moment) generated during rotation of the rotary shaft. The bending deformation or bending vibration causes stress to the rotary shaft. The weight of the turbine wheel 130 is reduced by the scallop 160 of this embodiment to decrease the stress applied to the rotary shaft.

Figure 5:
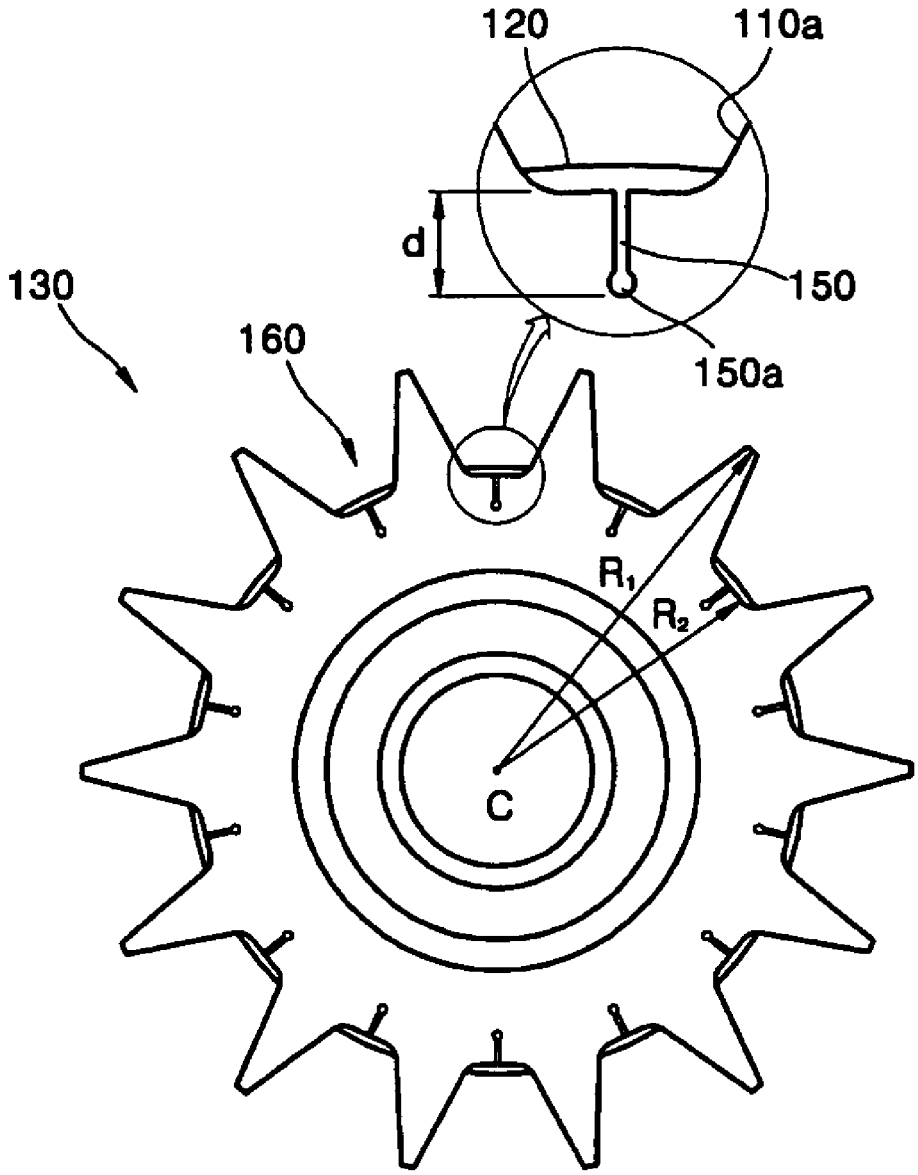
FIG. 5 is a rear view of the turbine wheel of FIG. 4.

It is preferable to restrict the size of the scallop 160 in a desired range. Referring to FIG. 5, the scallop 160 is preferably formed such that an innermost outer radius R2 of the periphery is above 75% of an outer radius R1 of the turbine blade 120. If the scallop is excessively large, the gas flowing in the turbine wheel may be leaked toward a back area, or the exhaust gas may not smoothly flow in the turbine wheel. As such, the present invention can prevent the reduction of turbine efficiency.

As can be seen from FIG. 4, the turbine wheel 130 of the present invention is provided with a plurality of slots 150 formed inwardly at the rear periphery 110a between the turbine blades 120. The slots 150 are radially formed between the turbine blades 120 at constant intervals. As can be seen from FIG. 5, an inner tip 150*a* of the slot 150 is formed in a round shape, such that stress applied to the tip 150*a* is dispersed to prevent a crack from being generated due to a stress concentration.

If the slots 150 are formed on the periphery 110*a* at which combustion heat of the exhaust gas is concentrated, it can suppress creation and propagation of a crack due to the thermal stress, the function of which will now be described with reference to FIG. 4.

In a transitional period, such as acceleration of the turbine wheel 130 (i.e., start of the gas turbine) or deceleration of the turbine wheel (i.e., stop of the gas turbine), there is a large temperature difference between the rear periphery 110*a* of the turbine wheel 130 contacted directly with the exhaust gas and the hub 110 centered on the turbine wheel. Specifically, at the acceleration of the turbine wheel 130, a temperature of the exhaust gas flowing in the turbine wheel 130 is raised up. As such, a temperature of the periphery 110*a* directly contacted with the exhaust gas is rapidly raised up, but a certain time is required until a temperature of the hub 110 at the center of the turbine wheel 130 is raised up. As a result, a transitional temperature difference occurs between the periphery 110*a* and the hub 110. Also, at the deceleration of the turbine wheel 130, the temperature of the exhaust gas flowing in the turbine wheel 130 is lowered down, and the temperature of the periphery 110*a* directly contacted with the exhaust gas is rapidly lowered down. Whereas, at the central hub 110 of the turbine wheel 130, a lapse of time is required until the temperature of the hub 110 is lowered to a similar temperature. As a result, the transitional temperature difference happens between the periphery 110*a* and the hub 110.

The transitional temperature difference results in a difference in thermal expansion, thereby applying the thermal stress (acting also as a hoop stress) to the periphery 110*a*. Specifically, at the starting of the gas turbine, an undue compressive stress exceeding the elastic limit of the turbine wheel is applied to the periphery 110*a*. At the stopping of the gas turbine, an undue tensile stress exceeding the elastic limit is applied to the periphery 110*a*. Repetition of the starting and stopping of the gas turbine causes the thermal stress to be periodically applied to the turbine wheel 130, thereby producing a crack and thus shortening the life span of the turbine wheel. If the turbine wheel 130 is provided with slots 150, a resistance against a crack is increased, and a growth rate of the crack is slowed down.

According to one embodiment of the present invention, such a crack development and optimal condition of the slot formation can effectively be analyzed with the aid of a computer. One exemplary analysis result was illustrated in FIGS. 6 and 7.

For instance, such a computer-aided analysis can calculate a stress intensity factor at a crack tip by use of a finite element analysis. The stress intensity factor is a coefficient to define the stress distribution at the tip portion of the crack, in which the stress at one point adjacent to the crack tip is determined by a stress concentration factor and the position of the one point relative to the crack tip. The magnitude of the stress concentration factor is determined by the size and shape of the crack.

Although not shown in the figures, the computer analysis utilizes a finite element model with a scallop and a crack cut at the rear periphery of the hub formed toward the inside of the hub between turbine blades. For instance, the finite element analysis can calculate the stress intensity factor, without being restricted by the shape of the crack. The stress distribution of the turbine wheel under certain load conditions can be obtained from analyzing the results on a temperature distribution at the transitional state. In particular, the temperature distribution of the turbine wheel was obtained by analyzing the temperature distribution of the turbine wheel during one period from the start to the stop, and the stress distribution calculated from this result is applied to load conditions.

Figure 6:
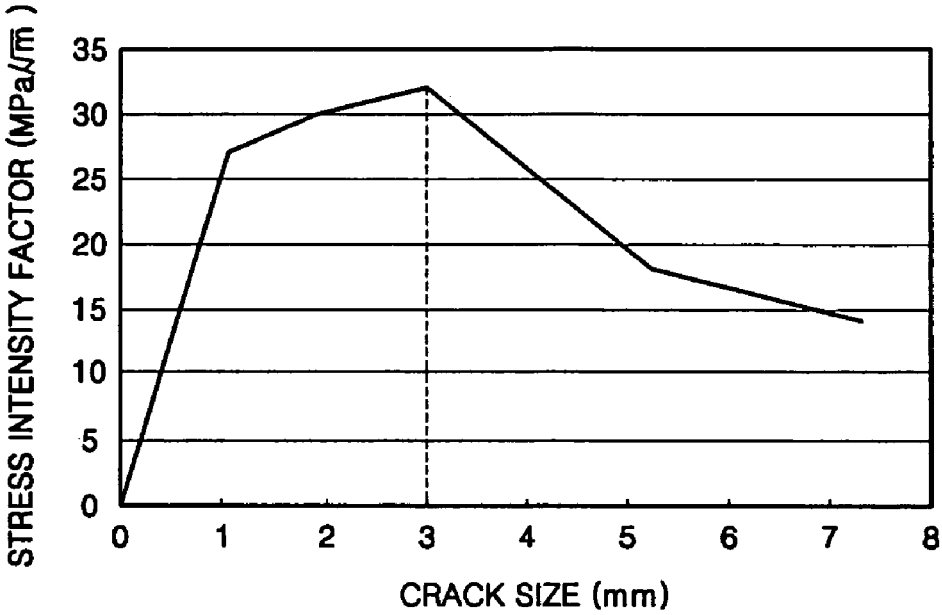
FIG. 6 is a graph of the variation of a stress intensity factor according to crack sizes.

FIG. 6 shows a variation of the stress intensity factor according to the size of the crack. Referring to FIG. 6, if the crack size is below 3 mm, as the crack size increases, the stress intensity factor also increases. However, if the size of the crack is above 3 mm, as the crack size increases, the stress intensity factor decreases. The decrease of the stress intensity factor indicates decrease of the stress acting on the crack tip and thus slowdown of the growth rate of the crack. Accordingly, the preferable cut depth 'd' (FIG. 5) of the slot from the outer periphery toward the inside is designed to have at least 3 mm based on the analysis result as illustrated in FIG. 6.

A propagation behavior of the crack can be calculated from the following Paris Equation, which is a differential equation (for example, see "Fatigue Design: Life Expectancy of Machine Parts" by Eliahu Zahavi, CRC Press, pp. 163-166, 1996):

$$\frac{da}{dN} = C \times (\Delta K^m)$$

wherein, $$\frac{da}{dN}$$

is a variation of a crack size for the cycle change, in which the cycle means a series of operating periods from the start to the stop of the turbine wheel. Also, ΔK is a variation of the stress intensity factor, and the variation value of the stress intensity factor corresponding to the crack size can be obtained from the results shown in FIG. 6. In addition, C and m are constants which can be experimentally obtained from test results.

Figure 7:
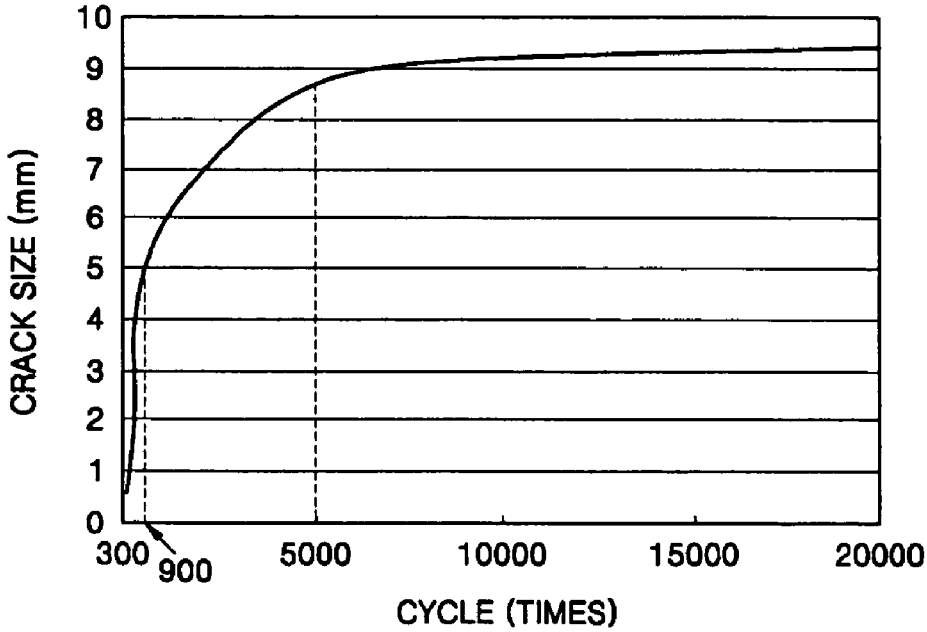
FIG. 7 is a graph of the variation of a crack size according to the cycle of a turbine wheel.

The crack size for every cycle can be calculated by integrating the Paris Equation, one result of which was shown in FIG. 7. Here, an initial condition was set to have an initial crack size of 0.5 mm after carrying out 300 cycles, which reflects a general condition in creating the crack according to one embodiment of the present invention.

The crack grows as the cycle increases, however, the growth rate of the crack slows down. In particular, according to one embodiment of the present invention as shown in FIG. 7, the crack was grown abruptly at the initial cycle of between about 300 cycles and about 900 cycles. The crack size became about 5 mm at 900 cycles. However, after reaching about 900 cycles (i.e., when the crack size becomes about 5 mm), the growth rate of the crack was slowed down. Thereafter, after reaching about 5000 cycles, when the crack size reaches about 8.6 mm, the growth rate of the crack was remarkably slowed down and the crack size was eventually maintained at a generally constant level. It will be apparent from the above analysis results that when the crack size becomes above a given level, the growth rate of the crack is slowed down rapidly. According to the present invention, an optimal cut-depth 'd' (FIG. 5) of the slot can be determined based on the above described analysis results. Thus, it is more preferable to have the cut-depth 'd' of the slot greater than 5 mm because the growth rate of the crack slows down significantly after this point.

Figure 8:
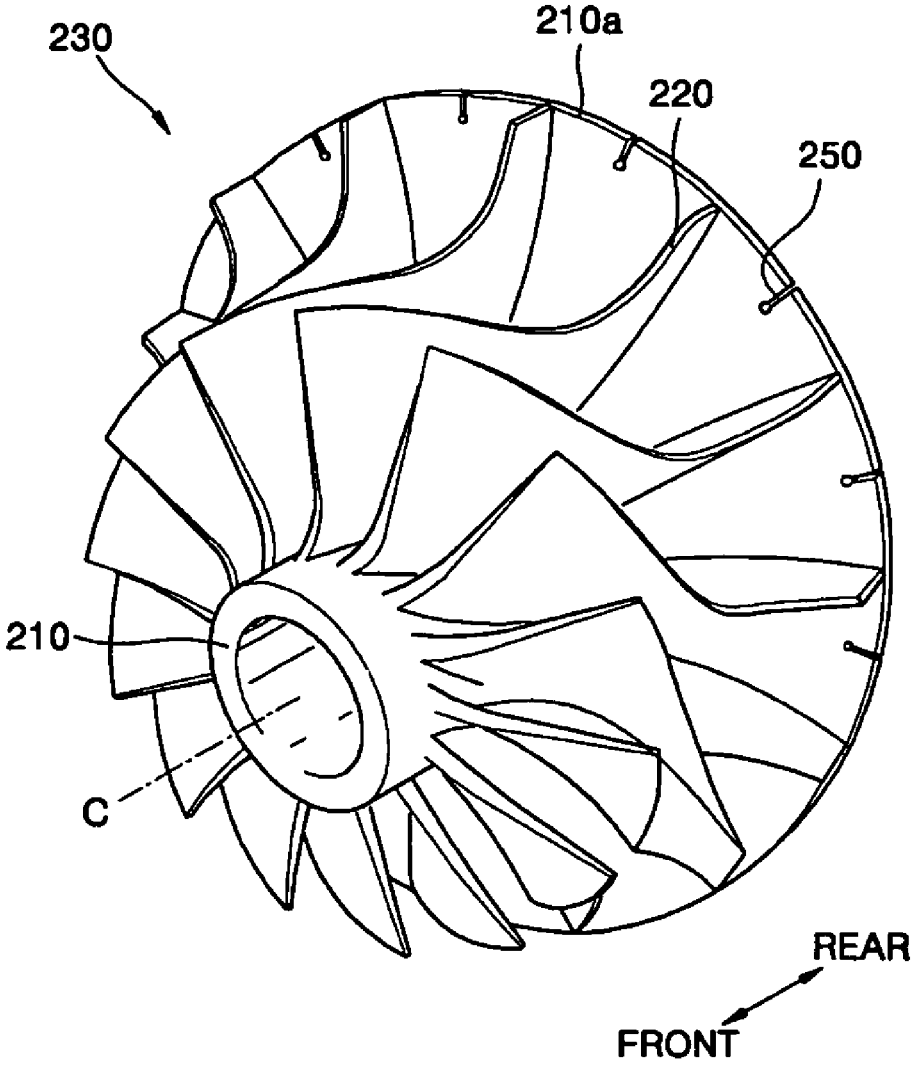
FIG. 8 is a perspective view of a turbine wheel according to another embodiment of the present invention.
Figure 9:
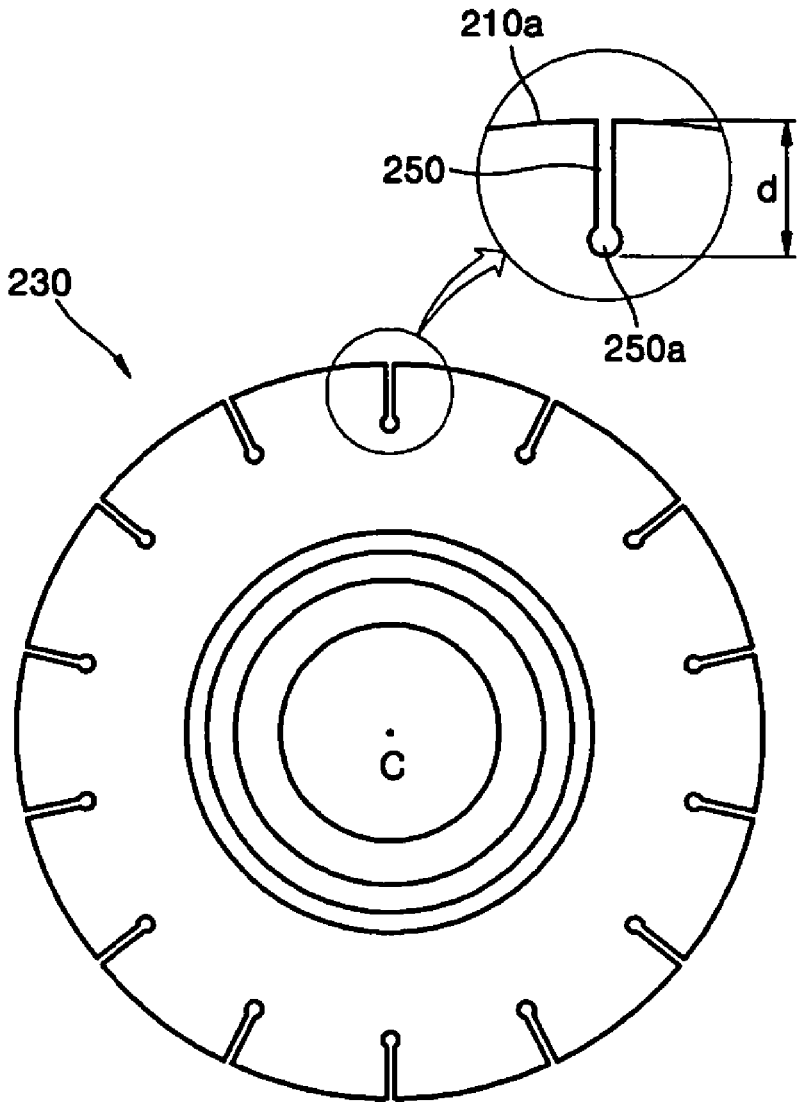
FIG. 9 is a rear view of the turbine wheel in FIG. 8.

FIG. 8 shows the turbine wheel according to another embodiment of the present invention. Referring to FIG. 8, turbine wheel 230 includes hub 210 receiving a rotary shaft (not shown), and a plurality of turbine blades 220 formed around the hub 210 at certain intervals. The hub 210 includes a plurality of slots 250 formed inwardly (e.g., radially) at a rear periphery 210*a*. A cut-depth 'd' (FIG. 9) of the slot 250 and the round shape of slot tip 250*a* are substantially identical with those of the prior embodiment described above, and the description of which will be not repeated.

Figure 1:
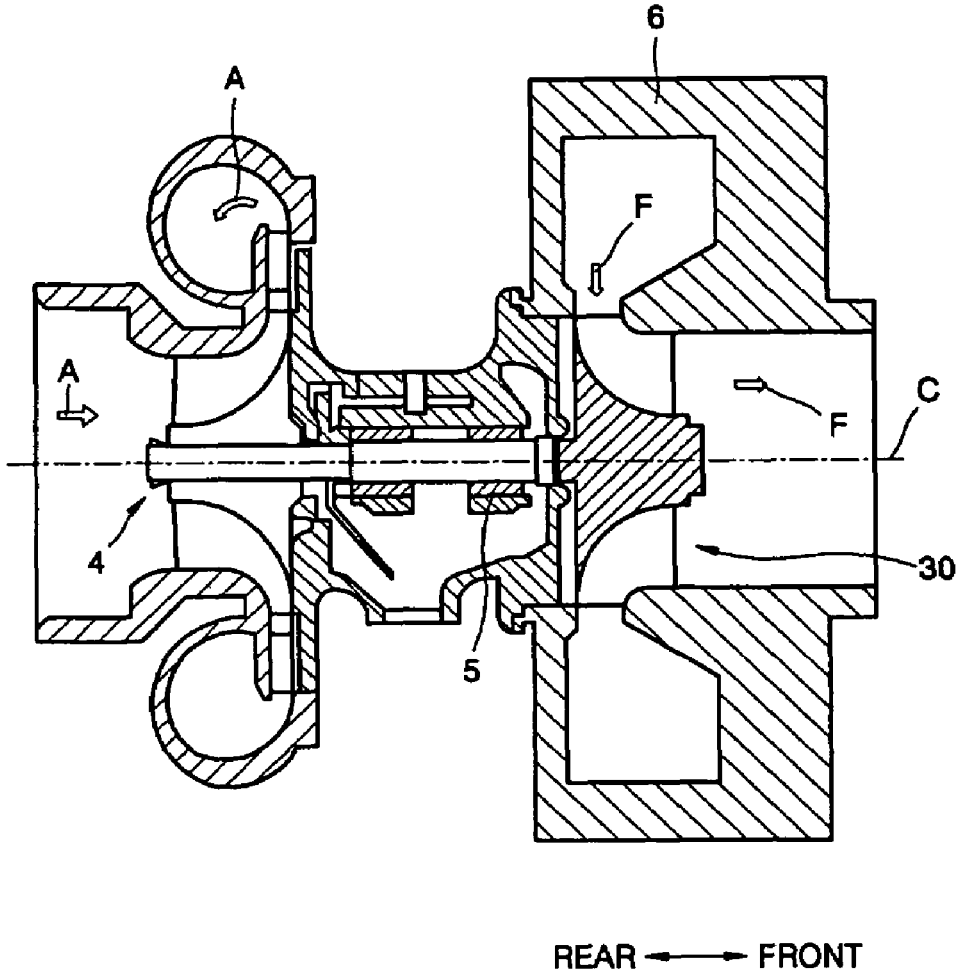
FIG. 1 (PRIOR ART)
FIG. 1 is a schematic cross-sectional view of a conventional turbocharger.
Figure 2:
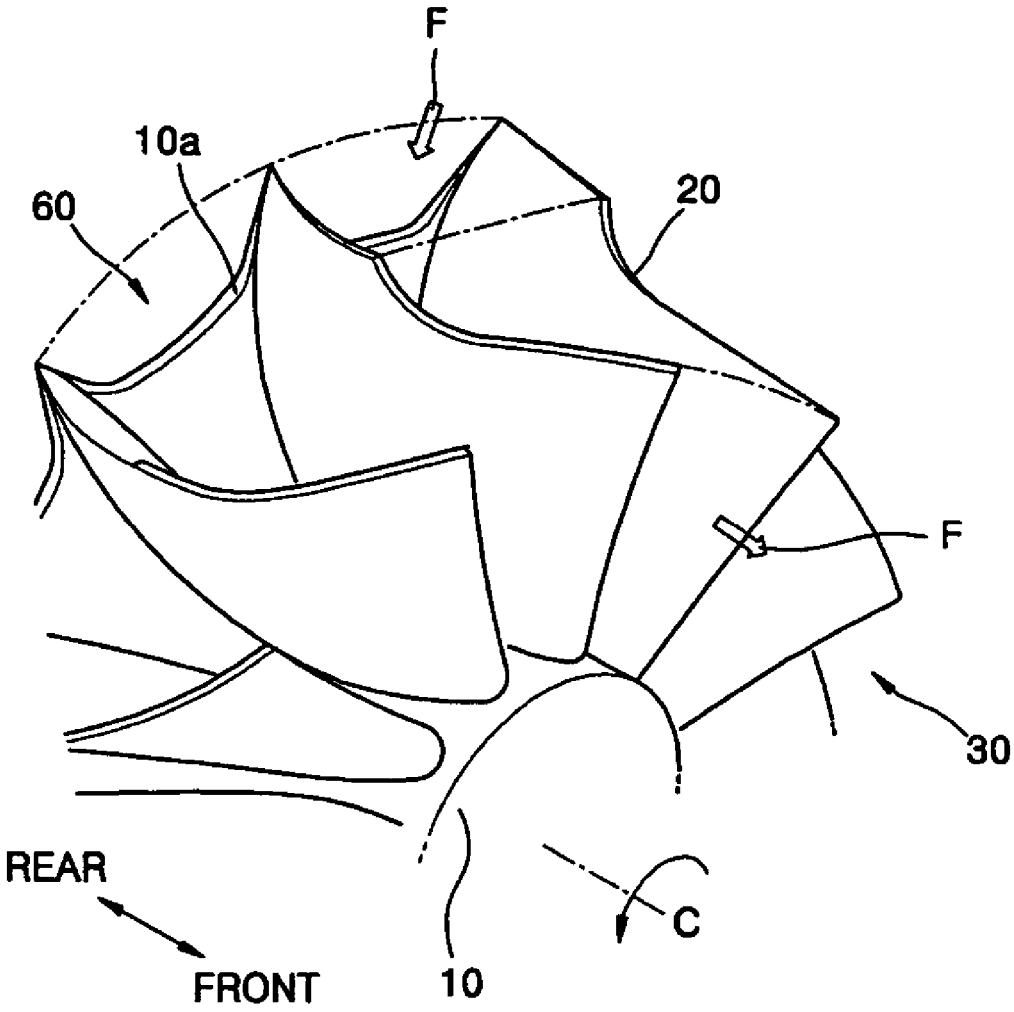
FIG. 2 (PRIOR ART)
FIG. 2 is a partial and perspective view of a conventional turbine wheel.
Figure 3:
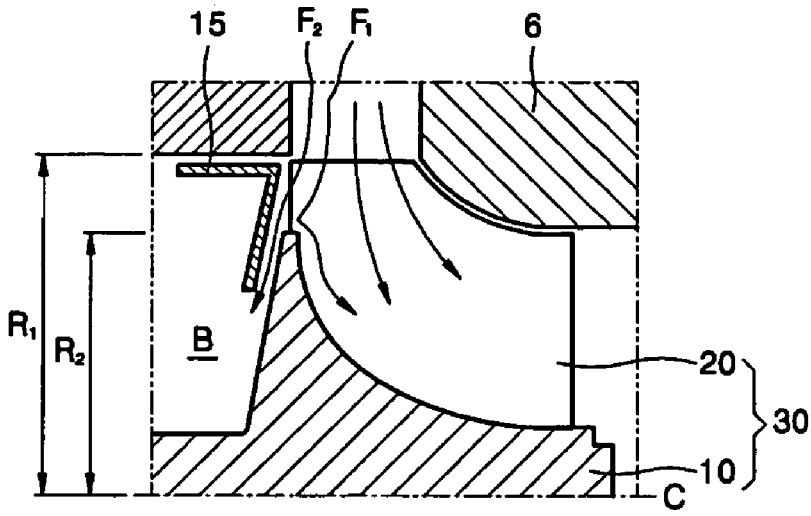
FIG. 3 (PRIOR ART)
FIG. 3 is a partial and schematic cross-sectional view of the turbine wheel in FIG. 2.

A distinctive feature of this embodiment is that the scallop is not formed at the rear periphery between the turbine blades, which is distinct from the first embodiment. In other words, the rear periphery 210*a* of the hub 210 is formed in a smooth shape, so that the exhaust gas flowing in the turbine wheel 230 is not leaked to a back area or disturbance of the exhaust gas inflow section is decreased (see FIG. 3), thereby improving the operating efficiency of the turbine wheel 230.

With the above description, the radial-flow turbine wheel of the present invention can obtain the following effects:

The radial-flow turbine wheel restricts the scallop in a desired size, so as to prevent leakage of the exhaust gas flowing into the turbine wheel or to limit the disturbance in the inflow section. Accordingly, it can prevent the decrease of the efficiency of the turbine and it can be expected to increase the operating efficiency thereof.

In addition, the radial-flow turbine wheel is provided with the inwardly cut slots, so as to suppress the creation and propagation of the crack due to the thermal stress. In addition, an optimal design specification of the cut-depth of the slot is also provided by the present invention to maximize the resistance against the crack.

Although the present invention is described with reference to the turbocharger, the features of the present invention are not limited thereto. The present invention may be applied to an air supplying unit for a fuel battery or auxiliary power unit.

While the present invention has been particularly shown and described with reference to exemplary embodiments described and depicted with the accompanying drawings, it will be understood by those of ordinary skill in the art that various changes and modifications in form and details may be made therein without departing from the spirit and scope of the present invention as disclosed in the accompanying claims.

What is claimed is:

1. A radial-flow turbine wheel for a gas turbine, the radial-flow turbine wheel comprising:

a hub having a generally cylindrical front end, an intermediate portion with an outer radius generally increasing from the front end to a rear end, the rear end of the hub having an enlarged outer periphery;

a plurality of turbine blades formed around the hub at constant intervals, the turbine blades rotating the radial-flow turbine wheel powered by expansion of an operating fluid of high temperature and high pressure; and a plurality of elongate narrow slots, each of the elongate slots formed in a generally radial direction at a central and radially outmost edge of the enlarged outer periphery of the hub between two adjacent ones of the turbine blades for suppressing creation and propagation of cracks in the hub due to thermal stress by operation of the turbine wheel, the elongate slots formed in the enlarged outer periphery of the hub without reinforcing the outer periphery of the hub with an expanded outer rim, each of the elongate slots having a predetermined depth of at least 3 mm from the central and radially outmost edge of the enlarged outer periphery of the hub, an inner end of each of the elongate slots having an enlarged opening.

2. The radial-flow turbine wheel of claim 1, wherein the inner end of each of the elongate slots has a round end surface.

3. The radial-flow turbine wheel of claim 1, wherein each of the elongate slots has a depth of at least 5 mm.

4. The radial-flow turbine wheel of claim 1, wherein the enlarged outer periphery of the hub defines an inwardly-formed concavity between two adjacent turbine blades.

5. The radial-flow turbine wheel of claim 4, wherein an innermost outer radius of the periphery is greater than 75% of an outer radius of the turbine blades.

6. The radial-flow turbine wheel of claim 1, wherein the dimension of each of the elongate slots is determined by a finite element analysis for analyzing a stress distribution at the outer periphery of the hub.

7. The radial-flow turbine wheel of claim 1, wherein the radial-flow turbine wheel is usable for a turbocharger.

8. The radial-flow turbine wheel of claim 1, wherein the radial-flow turbine wheel is usable for a fuel battery.

* * * * *